US008015782B2

(12) United States Patent
Borderi et al.

(10) Patent No.: US 8,015,782 B2
(45) Date of Patent: Sep. 13, 2011

(54) CASE PACKER

(75) Inventors: Luca Borderi, Sasso Marconi (IT); Stefano Chergia, Bologna (IT); Valerio Soli, Bologna (IT)

(73) Assignee: G.D S.p.A. (IT)

( * ) Notice: Subject to any disclaimer, the term of this patent is extended or adjusted under 35 U.S.C. 154(b) by 120 days.

(21) Appl. No.: 12/385,724

(22) Filed: Apr. 17, 2009

(65) Prior Publication Data

US 2009/0260332 A1 Oct. 22, 2009

(30) Foreign Application Priority Data

Apr. 18, 2008 (IT) ..... BO2008A0242

(51) Int. Cl.
*B65B 35/50* (2006.01)

(52) U.S. Cl. ..... 53/537; 53/566

(58) Field of Classification Search ..... 53/537, 53/566, 564, 551, 168, 376.7
See application file for complete search history.

(56) References Cited

U.S. PATENT DOCUMENTS 4,566,836 A * 1/1986 Berger et al. ..... 414/791.6
4,633,655 A * 1/1987 Nigrelli, Sr. ..... 53/543
4,951,445 A * 8/1990 Thibault ..... 53/167
4,984,409 A * 1/1991 Focke ..... 53/53
5,426,921 A * 6/1995 Beckmann ..... 53/566
5,732,536 A * 3/1998 Lin et al. ..... 53/535
6,145,281 A * 11/2000 Hansen et al. ..... 53/447
6,290,448 B1 * 9/2001 Focke et al. ..... 414/222.01
6,477,819 B1 * 11/2002 Focke et al. ..... 53/53

FOREIGN PATENT DOCUMENTS

EP 1225128 7/2002
WO 2005/080239 9/2005

OTHER PUBLICATIONS

European Search Report dated Jul. 20, 2009 from counterpart European patent application.

* cited by examiner

*Primary Examiner* — Sameh H. Tawfik
(74) *Attorney, Agent, or Firm* — Timothy J. Klima; Shuttleworth & Ingersoll, PLLC

(57) ABSTRACT

Cigarette cartons are boxed by a case packer comprising a frame mounted on a base, a feed unit supplying collapsed box blanks, a station at which the boxes are packed, a feed unit by which the cartons are directed along a path running perpendicular to a feed path followed by the blanks, also first and second folding and closing assemblies by which the top end face and the bottom end face of the erected box are formed. The machine base affords a plurality of mounting points arranged symmetrically on either side of a vertical median plane, passing longitudinally through the base, so that the position of the feed unit can be reversed in mirror image relative to the median plane, as also can the positions of the first folding and closing assembly and the second folding and closing assembly.

21 Claims, 4 Drawing Sheets

CASE PACKER

BACKGROUND OF THE INVENTION

The present invention relates to a packaging machine, in particular a case packer.

The invention finds application advantageously in complete production lines for packaging products or commodities of whatever type, and in particular for packaging tobacco products such as cigarette cartons into cases, or boxes.

Conventionally, the starting material for packaging products of the type in question consists in a collapsed tubular blank of corrugated cardboard, presenting slits and precreased fold lines, such as can be erected to produce the typical parallelepiped shape of a case or box. These flat box blanks are conveyed generally to the packer ordered in stacks.

Case packers of prior art type comprise an erector unit by which each collapsed blank in turn is opened up and spread to the point of assuming a tubular parallelepiped appearance, and a feed unit by which the single blanks are taken up one by one from an infeed station forming part of this same unit, and transferred to the erector unit.

The machine further comprises a packing station where the boxes are filled, located adjacent to the erector unit, which is supplied with products by a further feed unit positioned on one side of the machine.

Consequently, when designing a packaging line, care must be taken to adapt the installation of the case packer to suit the position of the product feed unit, or alternatively, the manufacturer must order and purchase a machine specifying the side from which the products are to be supplied.

Once filled and sealed, the cases or boxes are quality controlled to verify their weight and integrity, before proceeding along a horizontal path at a height accessible to the operator, or along an upwardly directed vertical path.

In this latter instance, the machine is rendered more compact.

In operation, the quality control procedure may reveal that the occasional box has not been filled correctly or sealed properly, and consequently must be discarded. In this situation, when affecting a vertical case packer of prior art type, the operator must stop the machine and suspend the packaging process, then climb up to retrieve the rejected item, with the result that production time is lost, and the operator is also placed at personal risk.

The object of the present invention is to provide a case packer that will be unaffected by the drawbacks mentioned above.

In particular, the object of the present invention is to provide a machine that will be both versatile and adaptable to any type of box-filling line, regardless of which side the products happen to approach the packing station.

A further object of the invention is to provide a case packer of simple and compact design, such as will allow of eliminating down time in the event of boxes being rejected, and avoid exposing the operator to personal risk when retrieving items flagged as substandard.

Yet another object of the invention, finally, is to provide a case packer such as will allow a swift and simple changeover to box blanks of different size or pattern.

SUMMARY OF THE INVENTION

The stated objects are realized according to the present invention in a case packer comprising a frame mounted on a base, a box feed unit supplying flat blanks, a packing station at which the boxes are filled, a feed unit by which products are directed along a path extending perpendicular to a feed path followed by the blanks, a first folding and closing assembly by which the top end face of the box is formed, and a second folding and closing assembly by which the bottom end face of the box is formed.

The base presents a plurality of mounting points arranged symmetrically on either side of a vertical median plane, in such a manner that the position occupied by the product feed unit is mirror image reversible relative to the median plane, and the positions occupied by the first folding and closing assembly and by the second folding and closing assembly are interchangeable, relative likewise to the median plane of the base.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
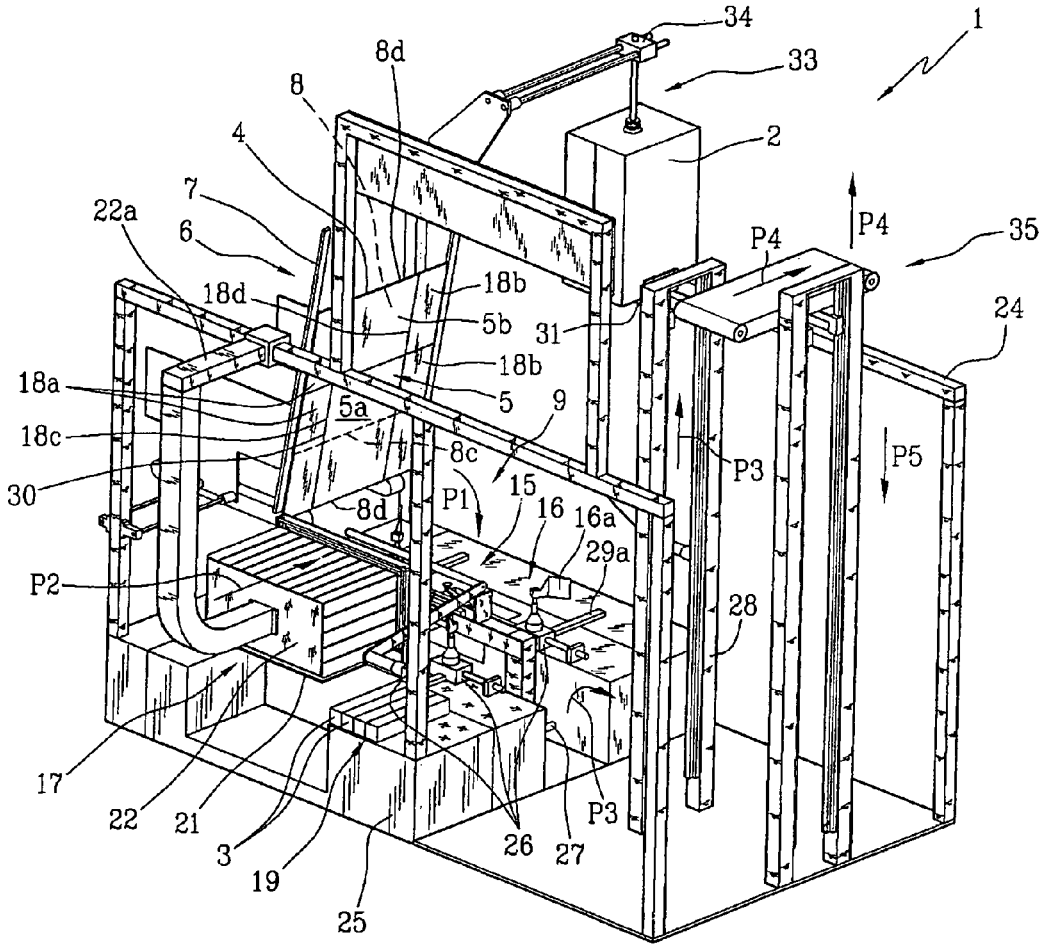
FIG. 1 illustrates a case packer according to the present invention, viewed in perspective from the side on which products are supplied to the machine.

With reference to the accompanying drawings, numeral 1 indicates a packaging machine, in its entirety, and more exactly a case packer for erecting and filling boxes 2 destined to contain products 3, preferably cartons 3 of tobacco products, and in particular cigarettes.

The machine 1 comprises a frame 24, and a base 25 on which a plurality of processing units and stations are mounted, each to be described in due course.

The machine 1 comprises a feed unit 6 by which cases or boxes are supplied in the form of collapsed tubular blanks 4, each appearing as two portions or leaves of cardboard placed face to face and joined along two longitudinal folded edges; in effect, therefore, the feed unit 6 supplies blanks 4 rather than actual boxes. Nonetheless, the unit is also referred to as a box feed unit hereinafter for the sake of simplicity.

The blanks 4 are fashioned advantageously of corrugated cardboard and diecut to shape, with slits and crease and/or fold lines, in such a way that each can be erected to assume the typical parallelepiped appearance of a case or box.

The box feed unit 6 comprises a supporting structure 7 on which the blanks 4 are positioned, preferably aligned and stacked face to face, on edge, with a first surface 5 on one side directed toward the centre of the machine 1, and a second surface 8 on the opposite side directed away from the machine.

Figure 2:
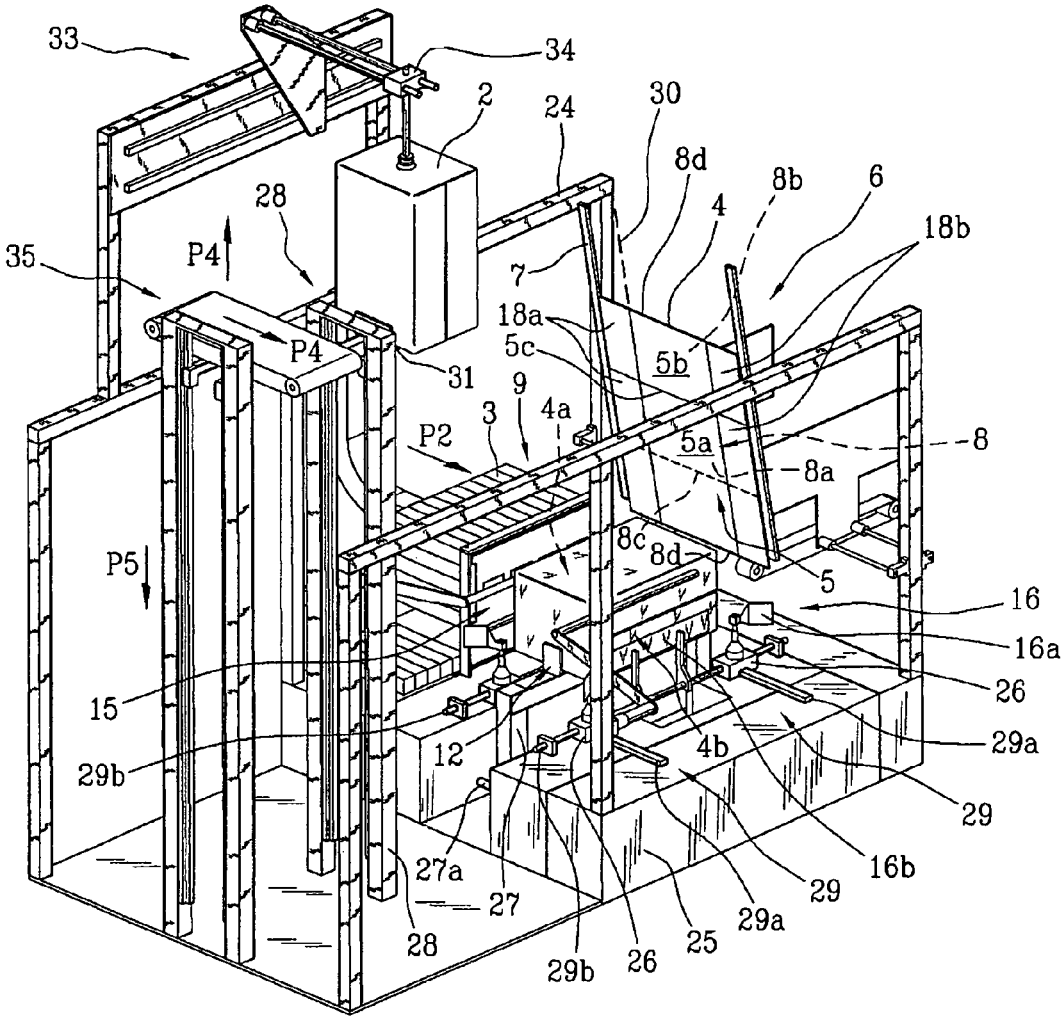
FIG. 2 shows the case packer of FIG. 1, viewed in perspective from the side opposite to that on which the products are supplied to the machine.

As shown in FIGS. 1 and 2, the first surface 5 of the blank 4 presents two main portions 5*a* and 5*b*, larger and smaller respectively, and the second surface 8 presents two main portions 8*a* and 8*b*, likewise larger and smaller respectively. The larger portion 5*a* and the smaller portion 5*b* of the first surface 5 are joined along a respective crease line, denoted 5*c*, as likewise the larger portion 8*a* and the smaller portion 8*b* of the second surface 8 are joined along a respective crease line, denoted 8*c*.

Similarly, the larger portion 5*a* of the first surface 5 and the smaller portion 8*b* of the second surface 8, and likewise the smaller portion 5*b* of the first surface 5 and the larger portion 8*a* of the second surface 8, are joined one to another along longitudinal folded edges denoted 8*d*.

The feed unit 6 supplying the blanks 4 comprises a gripper arm 11, hinged at one end 10 and pivotable about an axis of rotation 10*a* coinciding with this same end. The gripper arm 11 is able to detach one blank 4 at a time from the supporting structure 7 and cause it to swing around the axis of rotation 10*a*, while maintaining a radial position relative to this same axis 10*a*, until positioned horizontally at a predetermined height above floor level on a bearing surface of which the embodiment will be described in due course.

The gripper arm 11 comprises a plurality of vacuum heads 11*a*, consisting for example in suction cup or pneumatic means, such as will adhere forcibly to the first surface 5 of the blank 4.

Also forming part of the machine 1 is a packing station 9 where each successive blank 4, having been opened and spread to assume the semblance of a box 2, is filled with a group of products 3. Accordingly, the gripper arm 11 transfers the single blanks 4 along a predetermined path P1 from the box feed unit 6 into the packing station 9, where each one is positioned horizontally, supported by the bearing surface aforementioned.

The machine 1 further comprises erector means 12, by which the collapsed flat blank 4 is opened and raised, ultimately assuming a tubular parallelepiped configuration of three-dimensional form, presenting a rectangular cross section and remaining open at the two opposite ends 4*a* and 4*b*.

Designed to operate at the packing station 9, the erector means 12 comprise at least one locating element 13 extending upward vertically from the bearing surface, in such a way as to interact with one of the two portions presented by the first surface 5 of the blank 4. The second surface 8 of the blank 4 is raised by the action of the locating element 13, while a portion of the first surface 5 of the blank 4 is retained by the vacuum heads 11*a*.

Figure 3:
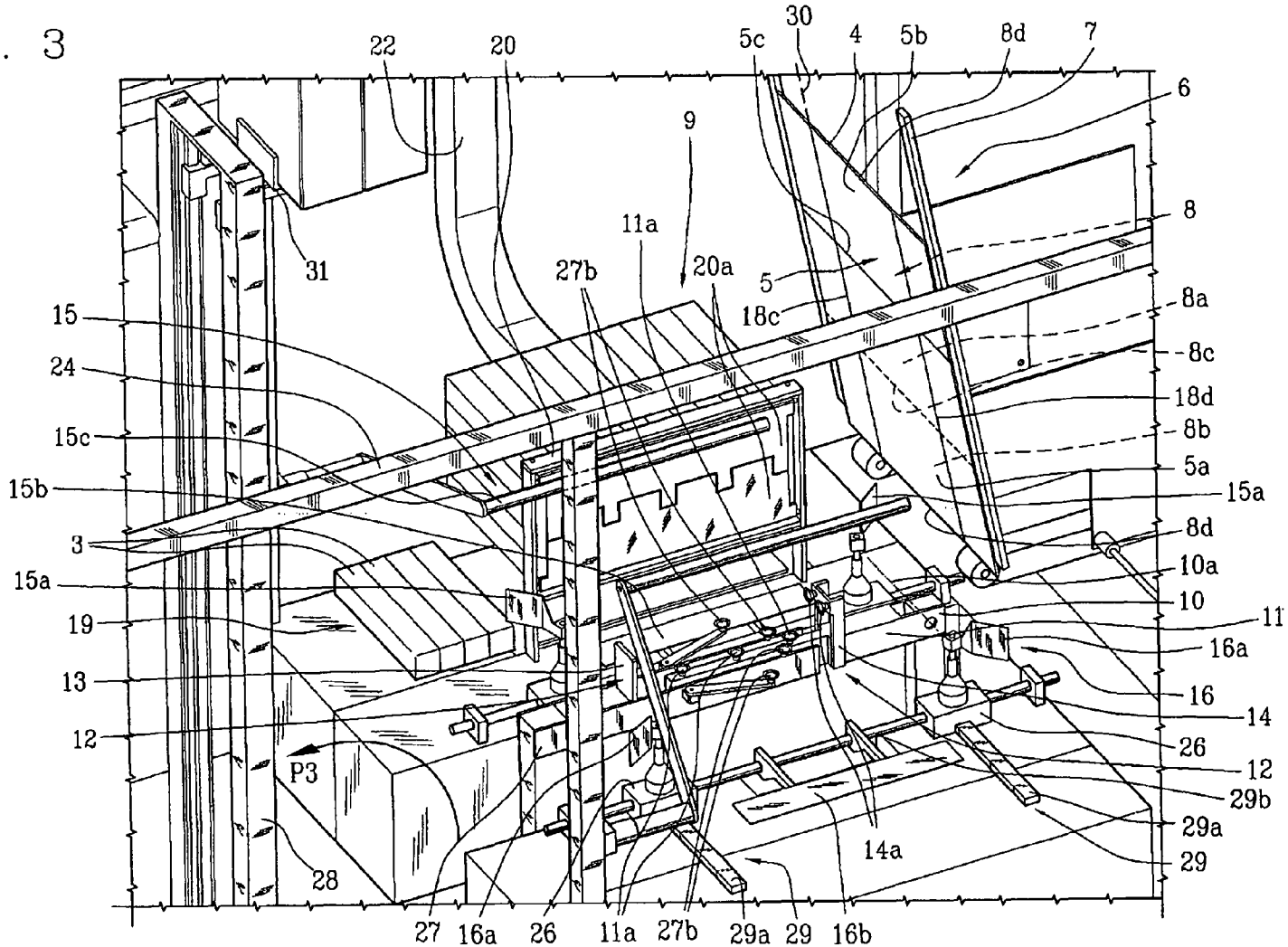
FIG. 3 shows an enlarged portion of the case packer according to the present invention.
Figure 4:
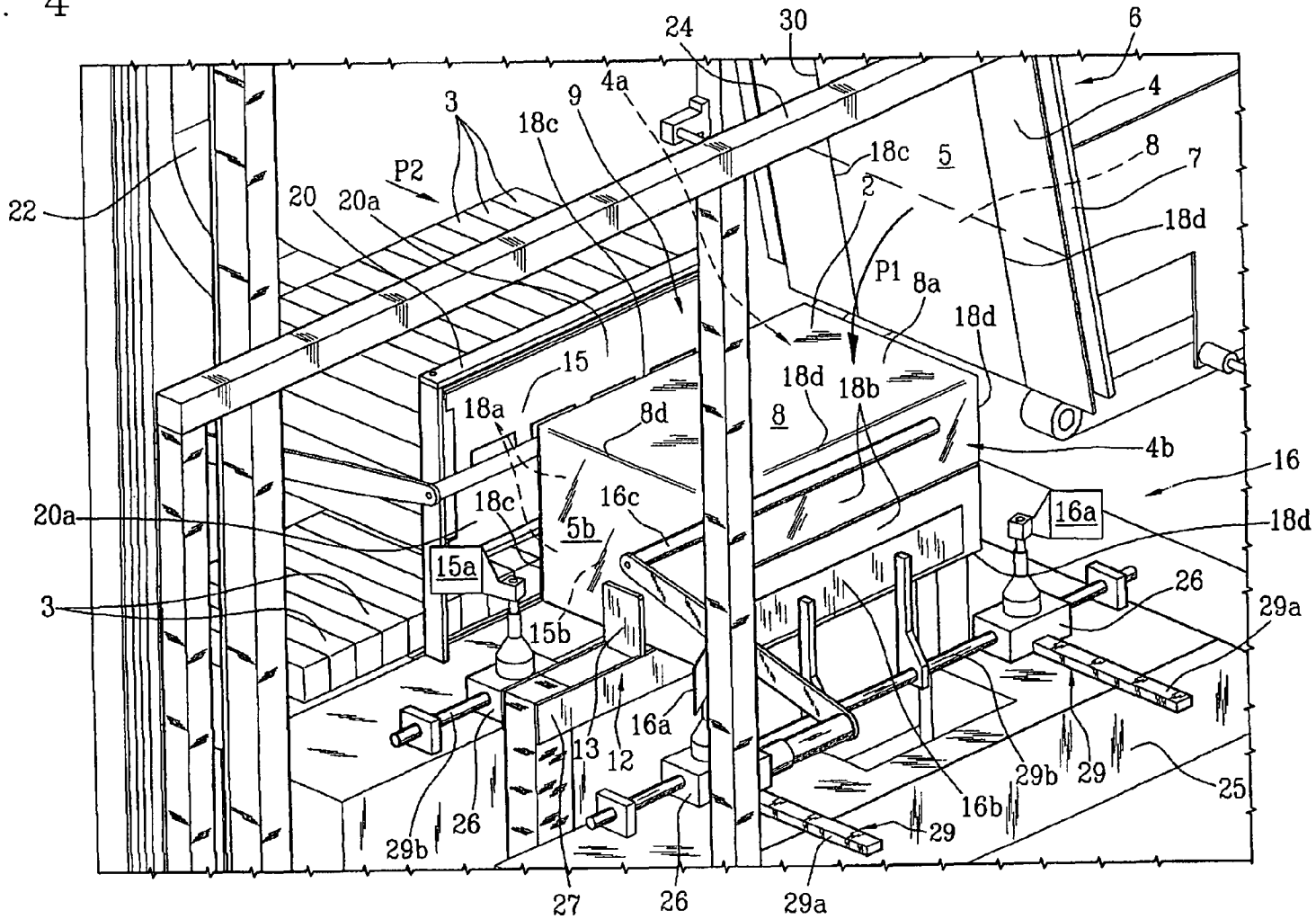
FIG. 4 shows an enlarged portion of the case packer as illustrated in FIG. 2.

The erector means 12 further comprise an uprighting device 14, equipped also with a plurality of gripper heads 14*a* (FIG. 3) incorporating suction cup or pneumatic means, for example, such as will adhere forcibly to the second surface 8 of the flat blank 4, which is directed upwards when the blank occupies the horizontal position.

The uprighting device 14 operates in conjunction with the locating element 13, and with the gripper arm 11 retaining the downwardly directed first surface 5, to raise the blank 4 from its initial flat condition to the three-dimensional configuration.

It is by the combined action of these components that the blank 4 is opened and erected into the form of a case, or box 2.

In the tubular configuration of the blank 4, the two opposite ends 4*a* and 4*b* each present four flaps 18*a* and 18*b* that will combine respectively to fashion the top and bottom end faces of the box 2. At this stage, the erected box 2 presents a bottom wall, a top wall and two side walls.

The four top flaps 18*a* and the four bottom flaps 18*b* are connected to the corresponding walls of the box along crease lines 18*c* and 18*d* extending orthogonally to the crease lines 5*c* and 8*c* located between the larger portions and the smaller portions of the first and second surfaces presented by the blank 4.

The case packer machine 1 is equipped on one side with a feed unit 17 supplying the products 3, which are inserted into the boxes 2 along a predetermined feed path P2 extending substantially perpendicular to the path P1 followed by the blanks 4. In particular, the unit 17 comprises a conveyor belt 19 by which the products are advanced from an infeed station (not illustrated) toward a loading gate 20. The loading gate 20 and the conveyor belt 19 are located preferably at different heights. Accordingly, the product feed unit 17 comprises an elevator 21 by which the group of products 3 to be packaged is transferred from the conveyor belt 19 to the loading gate 20. Finally, the feed unit 17 comprises a pusher element 22 by which the group of products is directed into the box 2. The pusher element 22 is slidable on a rail 22*a* cantilevered from the frame 24 of the machine 1.

The loading gate 20, which presents a preferably quadrilateral outline, is delimited by a set of four plates 20*a* arranged in two mutually opposed pairs; each plate 20*a* is hinged to one respective side of the loading gate 20, in such a way that the gate 20 can be opened and closed as necessary. When the group of products is ready for insertion into the box 2, the plates 20*a*, positioned normally in such a way that the loading gate 20 remains closed, are caused to rotate outwards to the point of opening up the gate 20 completely and locating flush against the four flaps 18*a* making up the top end face 4*a* of the box 2, thereby keeping this same end open while the products are introduced.

The machine 1 also comprises a first folding and closing assembly 15 operating on the top end face 4*a* of the box 2, and a second folding and closing assembly 16 operating on the bottom end face 4*b* of the box 2.

The first folding and closing assembly 15 comprises four folder elements, each positioned to engage a respective flap 18*a*, by which the top end face 4*a* of the box 2 is closed. Each flap 18*a* is caused to bend along a respective segment of the corresponding crease line 18*c* and assume a position orthogonal to the side walls of the box 2.

In similar fashion, the second folding and closing assembly 16 comprises four folder elements, each engaging a respective flap 18*b*, by which the bottom end face 4*b* of the box 2 is closed. Each flap 18*b* is caused to bend along a respective segment of the corresponding crease line 18*d* and assume a position orthogonal to the side walls of the box 2.

The folder elements both of the first assembly 15 and of the second assembly 16 comprise a respective pair of lateral plates 15*a* and 16*a*, pivotable about respective vertical axes of rotation, a respective bottom plate 15*b* and 16*b* pivotable about a horizontal axis of rotation, and a respective top bar 15*c* and 16*c*, capable of vertical movement, by which the relative topmost flap 18*a* and 18*b* is bent downwards and held in the folded position.

The bottom end face 4*b* of the box 2 will be closed preferably before the group of products 3 is inserted, so as to establish a travel limit for the products 3 directed into the box 2.

Once the products 3 have been inserted, the top end face 4*a* of the box 2 will be closed.

The case packer machine 1 further comprises an unloading arm 27 by which the box 2 filled with products is taken up, advanced and delivered to a transfer unit 28 (described hereinafter) operating downstream of the packing station 9.

The unloading arm 27 is hinged at one end 27*a* and rotatable about an axis extending parallel to the axis of rotation 10*a* of the gripper arm 11. During the step in which the products are directed into the box, the unloading arm 27 combines with the gripper arm 11 to create the bearing surface for the box 2.

This same surface presents a plurality of gripper heads 27*b*, comprising suction cup or other pneumatic means, for example, such as will adhere forcibly to the bottom face of the box 2. Also associated with the unloading arm 27 is the locating element 13 of the erector means 12, which during the unloading step functions as a restraint for the leading side wall of the box 2 and is pivotable as one with the unloading arm 27 about the relative axis of rotation.

The filled box 2 is guided by the unloading arm 27 along a feed path P3 comprising a first curved segment, describing an arcuate trajectory about the axis of rotation of the unloading arm 27. At the end of the curved segment, the box 2 is released by the arm 27 to a transfer unit 28 that comprises an elevator carriage 31 set in motion along a vertical trajectory establishing a second segment of the feed path P3.

The elevator carriage 31 conveys the box through a sealing station (not illustrated) and ultimately into an inspection station 33 where a suitable quality control system 34, located at a height above floor level greater than the height of the operator, will verify the integrity and the weight of the box 2 and check that it has been correctly filled.

To advantage, the quality control system will also comprise a plurality of sensors (not illustrated).

Downstream of the inspection station 33, along the aforementioned feed path P3 followed by the filled boxes 2, the machine 1 comprises a sorting station 35 at which correctly filled boxes and defective boxes are directed along respective feed paths. In particular, correctly filled and sealed boxes are directed along a feed path P4 preferably describing an ascending vertical trajectory, away from the operator, or a horizontal trajectory located at a height above floor level greater than the height of the operator, whereas defective boxes follow a feed path P5 initially describing a descending vertical trajectory, moving toward the operator, and thereafter a horizontal trajectory, at operator height, toward a discard station (not illustrated).

The alternating and coordinated movements of the components making up the folding and closing assemblies 15 and 16, likewise the gripper arm 11 and the unloading arm 27, are governed by electric motors located advantageously in the base 25 and operating in conjunction with cam means.

The base 25 also presents a plurality of mounting points 26 for the various elements and devices of the units and assemblies described thus far and making up the machine to which the invention relates. The mounting points 26 are arranged symmetrically on either side of a median plane passing through the base 25, in such a way that the units and assemblies of the machine 1 present a mirror image, and are therefore reversible, relative to the selfsame median plane.

The median plane is vertical and disposed longitudinally relative to the machine, that is to say, the plane lies parallel to the feed direction P1 followed by the blanks and thus perpendicular to the feed direction P2 along which the products 3 are loaded into the box.

More exactly, the mounting points 26 afforded by the base 25 are arranged in such a manner that the feed unit 17 supplying the products can be positioned on either side of the machine 1, in mirror image. Similarly, the symmetrical arrangement of the mounting points 26 is such that the position of the first folding and closing assembly 15 can be interchanged with that of the second folding and closing assembly 16, likewise relative to the median plane of the base 25, and consequently adapted to the position selected for the feed unit 17 supplying the products.

In like manner, the frame 24 presents a plurality of mounting points 26 that will allow certain components, such as the pusher element 22, to be installed on either side according to the placement of the machine in the context of a given production line.

The base 25 of the machine also comprises adjustment means 29, by which the position of certain parts can be shifted, and the machine 1 thus adapted to receive and process boxes 2 of different sizes.

More precisely, such adjustment means 29 comprise tracks 29*a* extending perpendicular to the median plane and affording a slidable mount for the second folding and closing assembly 16, by which the bottom end face 4*b* of the box 2 is formed. Accordingly, the distance by which the second folding and closing assembly 16 is separated from the first folding and closing assembly 15 can be adjusted so as to adapt the position of the second assembly 16 to the size of box 2 in production.

Similarly, the adjustment means 29 also comprise tracks 29*b* extending parallel to the median plane, along which the first and second folding and closing assemblies 15 and 16 can be moved nearer to or farther from the box feed unit 17.

Numeral 30 denotes a reference line representing machine zero, and coinciding with the crease line 18*c* along which the flaps making up the top end face 4*a* of the box 2 are bent.

Accordingly, this same reference line 30 is also repositionable symmetrically, relative to the median plane of the base 25, in the event that the position of the feed unit 17 supplying the products 3 should be switched from one side of the selfsame median plane to the other.

Advantageously, the first folding and closing assembly 15 is aligned with the reference line 30 of the machine 1.

The symmetrical design of the base thus ensures adaptability of the case packer to any packaging line, as well as versatility of the machine 1 in the event of existing production lines being reorganized.

Moreover, the provision of a discard station at operator height will ensure that substandard items can be removed in safety by a person manning the machine, and without any interruption of the production cycle.

What is claimed is:

1. A machine for packing groups of products into boxes, comprising:

a frame mounted on a base;

a box feed unit supplying flat blanks;

a packing station at which the boxes are filled;

a product feed unit by which products are directed along a predetermined path substantially perpendicular to a predetermined feed path followed by the blanks;

a first folding and closing assembly by which a top end face of a box is formed, and a second folding and closing assembly by which a bottom end face of the box is formed;

a plurality of mounting points to which the product feed unit, the first folding and closing assembly and the second folding and closing assembly can be mounted, the mounting points arranged symmetrically on both sides of a vertical median plane passing through the base, such that the product feed unit can be mounted in a position which is mirror image reversible relative to the vertical median plane, and the positions occupied by the first folding and closing assembly and by the second folding and closing assembly are also interchangeable relative to the vertical median plane.

2. A machine as in claim 1, wherein the base comprises an adjustment mechanism by which the machine can be adapted to a size and pattern of box being filled.

3. A machine as in claim 2, wherein the adjustment mechanism comprises tracks extending perpendicular to the vertical median plane and allows selection of a distance by which the second folding and closing assembly operating on the bottom end face of the box is separated from the first folding and closing assembly operating on the top end face of the box.

4. A machine as in claim 2, wherein the adjustment mechanism comprises tracks extending parallel to the vertical median plane and allows selection of a distance by which the first and second folding and closing assemblies are separated from the box feed unit.

5. A machine as in claim 1, comprising a reference line coinciding with a crease line along which the top end face of the box is folded, and mirror image reversible relative to the vertical median plane in an event of the product feed unit being repositioned likewise mirror image reversibly on either side of the vertical median plane.

6. A machine as in claim 5, wherein the first folding and closing assembly is aligned on the reference line of the machine.

7. A machine as in claim 1, wherein the box feed unit comprises a supporting structure supporting a stack of boxes in a form of flat blanks, and at least one gripper arm by which the blanks are transferred singly from the supporting structure to the packing station where the boxes are filled.

8. A machine as in claim 7, wherein the gripper arm comprises a plurality of vacuum heads.

9. A machine as in claim 1, comprising an erector mechanism for erecting the single blanks, operating at the packing station.

10. A machine as in claim 9, wherein the erector mechanism comprises a locating element for interacting with the box blank along the predetermined feed path, by pushing against at least one lateral portion of the box blank in a direction opposite to a direction followed by the blank along the predetermined feed path.

11. A machine as in claim 9, wherein the erector mechanism comprises an uprighting device designed for raising a top surface of the flat blank in a direction opposite to a direction followed by the blanks along the predetermined feed path, thereby opening and spreading the box.

12. A machine as in claim 1, wherein the product feed unit comprises a loading gate through which the products are directed into the box, the loading gate having a first pair of plates and a second pair of plates by which flaps making up the top end face of the box are held in an open position as the group of products is inserted into the box.

13. A machine as in claim 1, wherein the feed unit supplying the products is equipped with a feed mechanism by which the products are conveyed to the loading gate.

14. A machine as in claim 13, wherein the feed mechanism comprises a conveyor belt by which groups of products are assembled at the loading gate, and a pusher element by which the assembled products are directed through the gate and into the box.

15. A machine as in claim 1, wherein the first folding and closing assembly operating on the top end face of the box comprises two lateral folder plates, a bottom folder plate, and a top folder bar.

16. A machine as in claim 1, wherein the second folding and closing assembly operating on the bottom end face of the box comprises two lateral folder plates, a bottom folder plate, and a top folder bar by which a flap of the bottom end face located uppermost is bent downwards.

17. A machine as in claim 1, comprising an unloading arm by which single boxes filled with products are taken up in succession from the packing station and released to a transfer unit.

18. A machine as in claim 1, comprising an inspection station incorporating a quality control system installed at a height of at least two meters above floor level, equipped with a plurality of sensors and serving to verify that the boxes are correctly filled.

19. A machine as in claim 1, comprising a station at which the boxes are sealed.

20. A machine as in claim 18, wherein the transfer unit comprises an elevator by which filled boxes are carried through the sealing station and as far as the inspection station.

21. A machine as in claim 18, comprising a sorting station, located on the feed path followed by the boxes, at which correctly filled and packed boxes are separated from substandard boxes and directed along respective feed paths, wherein the feed path followed by the correctly filled and packed boxes is located at a height greater than two meters above floor level, and the feed path followed by substandard boxes is located at operator height and comprises a discard station, likewise at operator height, where the substandard boxes are removed.

* * * * *